United States Patent [19]

Fitzner et al.

[11] 4,165,727

[45] Aug. 28, 1979

[54] AUTOMATIC FUEL PUMP SWITCH UNIT FOR FUEL-INJECTED INTERNAL COMBUSTION ENGINES

[75] Inventors: Arthur O. Fitzner; Francis E. Kruncos, both of Fond du Lac, Wis.

[73] Assignee: Brunswick Corporation, Skokie, Ill.

[21] Appl. No.: 821,758

[22] Filed: Aug. 4, 1977

[51] Int. Cl.[2] ..... F02N 17/00; F02D 29/06

[52] U.S. Cl. ..... 123/179 B; 123/179 L; 123/198 D; 290/7

[58] Field of Search ..... 123/179 B, 179 BG, 179 L, 123/198 D, 198 DB; 290/7

[56] References Cited

U.S. PATENT DOCUMENTS

| | | | |
|---|---|---|---|
| 2,912,595 | 11/1959 | Kehm et al. | 123/179 B |
| 2,949,906 | 8/1960 | Voigt | 123/179 B |
| 2,989,644 | 6/1961 | Schultz | 123/179 B |
| 3,398,731 | 8/1968 | Johansson | 123/198 D |
| 3,502,895 | 3/1970 | Ballou | 123/179 B |
| 4,077,381 | 3/1978 | Firey | 123/198 D |

*Primary Examiner*—Charles J. Myhre
*Assistant Examiner*—D. Reynolds
*Attorney, Agent, or Firm*—Andrus, Sceales, Starke & Sawall

[57] ABSTRACT

In an internal combustion engine an automatic fuel pump switch connects a fuel pump motor to the battery. An electronic sensing circuit is connected to the output winding of an engine-driven alternator which is also connected to charge the battery. The sensing circuit includes a sensing transistor connected to continuously sense the two instantaneous voltages relating to ground that appear as alternating current (A.C.) voltages at the opposite ends of the alternator output winding and produces an output only when one voltage is above a selected positive level while the other voltage is lower than the first voltage by a minimum amount. A control transistor circuit is connected to the output of the sensing transistor and is turned on to operate the fuel pump only when the engine is turning over at a sufficient rate to start and run.

12 Claims, 2 Drawing Figures

AUTOMATIC FUEL PUMP SWITCH UNIT FOR FUEL-INJECTED INTERNAL COMBUSTION ENGINES

BACKGROUND OF THE INVENTION

The present invention relates to an automatic fuel pump switch unit for a fuel-injected internal combustion engine and particularly to an automatic fuel pump switch unit which automatically controls the activation of the fuel pump operation in accordance with the rotational speed of the engine.

Fuel-injected internal combustion engines may employ a motor-driven fuel pump for supplying pressurized fuel to the various injectors. The injectors may be solenoid-controlled so as to inject the pressurized fuel into the intake manifold passageways for precisely controlled periods at repetition rates which are precisely related to the engine RPM. Or the injectors may be mechanically controlled in such a manner as to merely control or vary the flow rate of an uninterrupted injection of fuel into the intake air stream.

Fuel-injected racing engines may employ injectors which will not inject fuel until a supply of pressurized fuel is available. Conversely, these same injectors may not stop injecting fuel until the pressurized fuel supply is cut off. Such racing engines may thus require the race driver to manually turn on the fuel pump at the proper instant during starting, and conversely, to turn off the fuel pump immediately upon stopping the engine.

Although race drivers become skilled in the technique of turning on the fuel pump at the proper moment, various difficulties and malfunctions may occur if any significant timing errors are made. For example, if the fuel pump is turned on prior to the starting of the engine, flooding of the engine may occur. If the fuel pump is not turned on at the time of starting of an engine which already has adequate initial fuel in the manifold passageways for starting, this can lead to a lean-burn condition and destruction of the engine can result. Other problems are also present in the operation of driver controlled fuel pump systems. Racing drivers are normally required to use a safety tether switch which is connected to positively kill the engine ignition system in the event that the driver is thrown from the boat. In case of such an accident, however, the fuel pump may, of course, continue to operate, unless specially connected to the engine tether switch circuit. If a fuel line also ruptures as a result of an accident, a serious fire hazard may be created if the fuel pump continues to run indefinitely. With the above arrangement, the driver is also required to positively turn off the fuel pump during refueling, and after refueling reinitiate the precise turn-on of the fuel pump during the engine restarting procedure.

SUMMARY OF THE PRESENT INVENTION

The present invention is directed to an automatic fuel pump switch unit for turning the pressurized fuel supply on and off in accordance with engine operation and thereby eliminate the requirement for control by the driver. Generally, in accordance with the present invention, a controlled switch unit interconnects the fuel pump motor to a direct current (D.C.) power source. An electronic sensing circuit is connected to the output winding of an engine-driven alternator which is provided for charging the battery and providing operating power. The sensing circuit continuously senses the two instantaneous voltages relative to ground that appear and which may be referred to as alternating current (A.C.) voltages developed at the opposite ends of the alternator output winding. The sensing circuit produces the required output only when one voltage input is above or more positive than a selected level while the other input voltage is lower than the first input voltage by a minimum amount. The fuel pump switch unit thus insures that the fuel pump is not operative prior to the starting of the engine but is operative whenever the engine is turning over at a sufficient rate to start and run. The race driver does not, therefore, have to separately attend to the fuel pump operation. The system is insensitive to a positive output, such as the steady positive input voltage signal when the engine is not running, such as is present in certain voltage regulated supply systems. The above fire hazard is also significantly minimized because the fuel pump stops when the engine stops following actuation of the safety tether switch.

In a practical application, the sensing circuit includes a low-power bridge rectifier connected to the output of a permanent magnet alternator with the inputs of the low-power bridge connected in parallel with the inputs to the main power bridge rectifier. A sensing transistor means has one input electrode or element connected to the one side of the bridge and the second input electrode or element separately returned to the two bridge inputs through unilateral conducting means such as steering diodes. A storage capacitor in parallel with a resistor is connected in series with the output of the transistor means. When the transistor is turned on, the capacitor is charged from the more positive the two bridge inputs. At all normal cranking and running speeds the capacitor maintains sufficient voltage to keep the fuel pump fully turned on, even though the output of the sensing transistor may turn rapidly on and off. The voltage on the capacitor is supplied as input to a transistor switch assembly to turn it on and provide corresponding energization of the fuel pump motor. The fuel pump is thus turned on very shortly after the flywheel starts rotating, and turns off very quickly after it stops.

The main or power bridge rectifier may advantageously include an output voltage limiting circuit. If a battery cable is disconnected or becomes loose, the output of the power bridge then directly provides power to the fuel pump switch. The voltage limiting effect of the battery is, however, now removed and, without a separate voltage limiting means, the output voltage may rise to a level which damages the fuel pump motor. This condition can be avoided by employing a suitable output voltage limiting means connected to the alternator.

The present invention thus provides an automatic electric fuel pump system operating in synchronism with engine operation, and thereby eliminates the necessity of separate attention by the driver and the other hazards created by a separate manually operated fuel pump control system.

BRIEF DESCRIPTION OF THE DRAWING

The drawing furnished herewith illustrates a preferred construction of the present invention in which the above advantages and features are clearly disclosed as well as others which will be readily understood from the description of the illustrated embodiments.

In the drawing.

DESCRIPTION OF ILLUSTRATED EMBODIMENT

Figure 1:
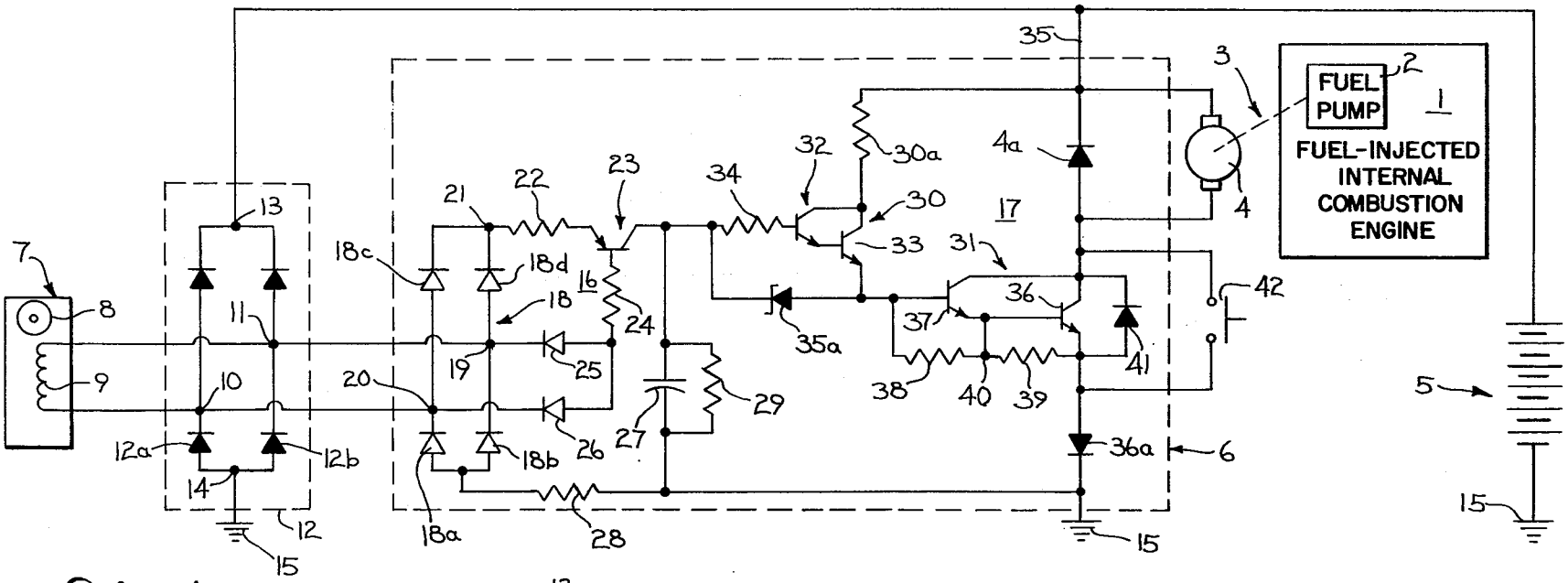
FIG. 1 is a schematic illustration of an automatic fuel pump switch unit for a fuel-injected internal combustion engine, in accordance with the teaching of the present invention.

Referring to the drawing and particularly to FIG. 1, a fuel-injected internal combustion engine 1 is illustrated as a block. The engine 1 includes a fuel pump 2 of any suitable construction which is coupled to and operated by an electric D.C. motor 3. The motor armature 4 is connected to a storage battery 5 in series with the automatic fuel pump switch unit 6, which particularly forms an embodiment of the present invention. Diode 4*a* is included in the fuel pump switch unit 6 to provide a path for the armature current as it decays, following any abrupt disconnection by switch unit 6 of the current flowing to the armature 4 from the battery 5. The engine 1 also includes a permanent magnet alternator 7 providing an alternating power source whenever the engine is operating. The alternator 7 includes a group of permanent magnets 8 which are mounted in the engine flywheel, not shown. An output winding 9 is magnetically coupled to the magnet group 8 and the opposite ends provide first and second A.C. voltages. The winding 9 is connected to the input terminals 10 and 11 of a full wave diode bridge 12, the output of which is connected to charge the battery 5 in accordance with well-known conventional construction. The rectifier bridge 12 is shown as a conventional full wave diode bridge having the positive output terminal 13 connected to the positive side of the battery 5 and the opposite or negative output terminal 14 connected to the common ground 15.

The output voltage level of the rectifier bridge 12 is limited by the storage battery 5, which thus provides some measure of voltage limiting of the alternator output.

The present invention is particularly directed to the automatic fuel pump switch unit 6 and no further description of the other components are given other than as necessary to fully and completely understand the illustrated embodiments of the present invention.

The illustrated embodiment of the automatic fuel pump switch unit 6 generally includes a voltage level sensing network 16 which is connected to sense the highest positive polarity voltage level of the two A.C. voltages and the relative levels of the two A.C. voltages. The sensing network 16 actuates a transistor circuit 17 in response to a minimum rotational speed of flywheel-mounted magnet group 8 to complete the energizing circuit to the armature 4 and thereby operate the motor 3 and interconnected fuel pump 2 in synchronism with the operation of engine 1.

More particularly, the sensing network 16 includes a low-power diode rectifier bridge 18 having input terminals 19 and 20 connected to the opposite ends of winding 9 and thus in parallel with the input to the power rectifier bridge 12. The positive output terminal 21 of the bridge 18 is connected in series with a resistor 22 to the emitter of level sensing transistor 23. The base of the transistor 23 is connected in series with a resistor 24 and a first diode 25 to the first input A.C. voltage terminal 19 and in series with a second diode 26 to the second A.C. input voltage terminal 20 of bridge 18.

A capacitor 27 has one side connected to the collector of the transistor 23 and the opposite side connected to the common system ground 15, which is connected in series with a resistor 28 to the return side of the bridge 18. When transistor 23 turns on, current flows from bridge 18, through resistor 22, transistor 23, capacitor 27 and resistor 28 back to the bridge. The capacitor 27 is charged from the more positive of the two A.C. inputs to bridge 18. A resistor 29 is connected to capacitor 27 to discharge the capacitor 27 when the engine and magnet group 8 stop. With the alternator 7 providing the appropriate A.C. voltages, the capacitor 27 charges and at an appropriate voltage level, the transistorized switch circuit 17 turns on. The transistor switch unit 17 includes a pair of Darlington transistor circuits 30 and 31 connected to sense the voltage level of capacitor 27 and complete the circuit to motor armature 4 when capacitor 27 is charged to the required voltage level. Circuit 30 includes a pair of transistors 32 and 33 connected in a Darlington configuration. The transistor 32 has its base connected in series with a resistor 34 to the positive side of the capacitor 27. The output of the Darlington connected transistors 32 and 33 is connected in series with current-limiting resistor 30*a* between the battery power connection lead 35 and the input to Darlington transistor circuit 31. A Zener diode 35*a* is also connected between the positive side of the capacitor 27 and the input to Darlington circuit 31.

The Darlington transistor circuit 31 includes a transistor 36 connected in series with the motor armature 4 and a reverse polarity blocking diode 36*a*. A transistor 37 is connected as the input transistor with its base connected in series with the output of the Darlington transistor circuit 30. Series connected bias resistors 38 and 39 are connected between the base of transistor 37 and the emitter of transistor 36. The common junction or node 40 of the resistors 38 and 39 is connected to the emitter of transistor 37 and to the base of transistor 36. The resistors 38 and 39 provide pathways bypassing the base-emitter junctions of transistors 37 and 36 to allow any high temperature collector-to-base leakage currents to flow without turning on the transistors. A protective diode 41 is connected in parallel with the output of transistor 36. Transistors 37 and 36, diode 41, and resistors 38 and 39 are all on the same silicon chip and contained within a common enclosure.

A normally open primer switch 42 is also connected across the transistor 36. The driver may close the switch 42 to directly operate the motor 3 and pump 2 for priming a cold engine 1.

For automatic fuel pump operation, capacitor 27 must charge to a voltage level above the required voltage drop across the input junctions of the Darlington connected transistors 32–33 and 37–36 and the diode 36*a* as well as provide current through the series resistor 34. At that level, the transistor switch circuit 17 is rapidly driven on to provide full voltage to the pump motor 3, thus causing the fuel pump 2 to supply fuel under pressure to the engine.

The fuel pump 2 is thus operated and remains operating so long as the output of the permanent magnet alternator 7 provides the two proper A.C. input voltages to repeatedly turn transistor 23 on and sustain the capacitor 27 above the required voltage. If the engine stops, the output of the alternator 7 decreases and the difference in the two voltages drops below the appropriate turn on voltage of transistor 23. The capacitor 27 rapidly discharges through the resistor 29 and the switching circuit 17 turns off.

The automatic fuel pump switch unit 6 starts the fuel pump 2 only when the flywheel is rotating. This provides the actuation of the fuel pump 2 to supply fuel at the proper time during starting and prevents possible engine damage from failure to provide adequate fuel to the engine which would result in an excessively lean condition for a short time. The automatic turn off of the pump whenever the engine stops also prevents an excessive building up of fuel in and around the engine, thus effectively minimizing the hazards of fire or explosions. In the engine stopped condition, no power is required by the switch and the drain on the battery is minimized.

Significant advantages in the construction and operation of the circuit are gained by the use of the two Darlington transistor circuits, which are not apparent without further explanation. Such advantages result primarily from the very low input current required by the base of transistor 32, at a significant voltage above ground, to fully turn on transistor 36.

Both the very low input current and the significant input voltage requirement are of course inherent in the double Darlington arrangement.

The very low input current characteristic allows all of the circuitry ahead of transistor 32 to normally operate at very low power levels. In the event that the main power rectifier 12 ceases to act as a voltage limiter on the alternator output, the input voltages at inputs 19 and 20 can be expected to increase by more than a factor of ten. Resistors associated with the input circuitry would have to handle power levels of perhaps 100 times normal or more. Thus, by operating at very low power levels under normal conditions, practical and inexpensive circuit components can be used which will still have adequate power-handling capabilities for the abnormal conditions.

Because of the low current levels and high resistor values allowed, capacitor 27 can be made quite small in electrical capacitance, and still do an adequate job of sustaining its voltage inbetween periods of charging from transistor 23. Further, in the event of a high-voltage input condition as described above, the voltage on capacitor 27 can be safely limited by an inexpensive low-power Zener device such as Zener 35*a*.

Resistor 34 couples capacitor 27 to the base of transistor 32. Those skilled in the art can readily appreciate the voltage clipping effect that would be imposed on capacitor 27 if resistor 34 were to be replaced by a conductor, or even by a low resistor. Thus, resistor 34 is also made high in resistance, so as to allow capacitor 27 to charge to a voltage well above the required voltage on the base of transistor 32. Therefore, when the engine is being cranked, the voltage on capacitor 27 can fluctuate, but will still remain high enough to maintain full turn-on of the double Darlington.

Resistor 22 limits the maximum charging current that can be sent into capacitor 27 during any abnormal conditions where the positive peak voltage on inputs 19 or 20 becomes very high, thus protecting transistor 23 and Zener 35*a* from overcurrents.

Resistor 24 is necessary to prevent discharging of capacitor 27 via the collector-base junction of transistor 23.

Resistor 28 and low-power bridge diodes 18*a*–18*b* allow the fuel pump switch to continue operating in the event that power bridge diodes 12*a* and 12*b* are no longer present, due to burn-out or the like.

The minimum positive input voltage required to achieve full turn-on of transistor 36 under the loads of the fuel pump motor is about 8 volts. Reverse-voltage-protection diode 36*a* requires about 1 volt under the motor current load, and Darlington 31 requires about 3.0 volts between the base of transistor 37 and emitter of transistor 36. This places the emitter of transistor 33 at 4.0 volts above ground; thus, the base of transistor 32 must go to about 5.2 volts above ground. Allowing about 1 volt total for the loss in diode 18*c* (or 18*d*) plus transistor 23 means that resistor 22 and 34 can share the remaining 1.8 volts. The design is such that resistor 34 consumes about 1.5 volts under normal conditions, and resistor 22 consumes very little.

The output transistor 36 should begin to turn off when the voltage on capacitor 27 drops below about 6.7 volts. Zener 35*a* is selected to have a Zener voltage of about 7.5 volts, which added to the 4 volt potential at the base of transistor 37 gives a maximum voltage on capacitor 27 of about 11.5 volts. Thus, bleeder 29 need only be able to draw down the voltage on capacitor 27 to about 60% of the maximum to get to the edge of turn off. Turn off should occur shortly after the engine stops, of course. Bleeder resistor 29 can be a relatively high-valued resistor, and thus low-powered, as contrasted to what it would have to be if it were necessary to drain capacitor 27 down to 0.5 volts or less in the same amount of time after the engine stops.

Further, a bleeder resistor 29 high enough to allow capacitor 27 to sustain adequate voltage for fuel pump operation during cranking, will not be too high to prevent the fuel pump from turning off promptly once the engine has stopped, because of the relatively high threshold of the double Darlington circuit built on top of diode 36*a*.

The only failure of the main bridge 12 which would prevent proper fuel pump operation is the shorting together of the two AC input terminals 10 and 11. Any short circuit existing between the output of the rectifier bridge 12 and ground 15 will be quickly burned open by the output of the storage battery 5. Consequently, this type of electrical system failure does not interfere with proper switch operation and, therefore, fuel pump operation.

The fuel pump system continues to operate if the ignition system is operating independently of the battery 5, the bridge 12 is functioning properly and a battery cable becomes disconnected or loose. The output of the bridge 12 then directly provides a power supply to the fuel pump switch unit 6. However, with battery 5 disconnected, the output voltage of the permanent magnet alternator 7 may rise to a level which damages the fuel pump motor. This can be avoided by providing a voltage limiting circuit which limits the output of the alternator 7.

Figure 2:
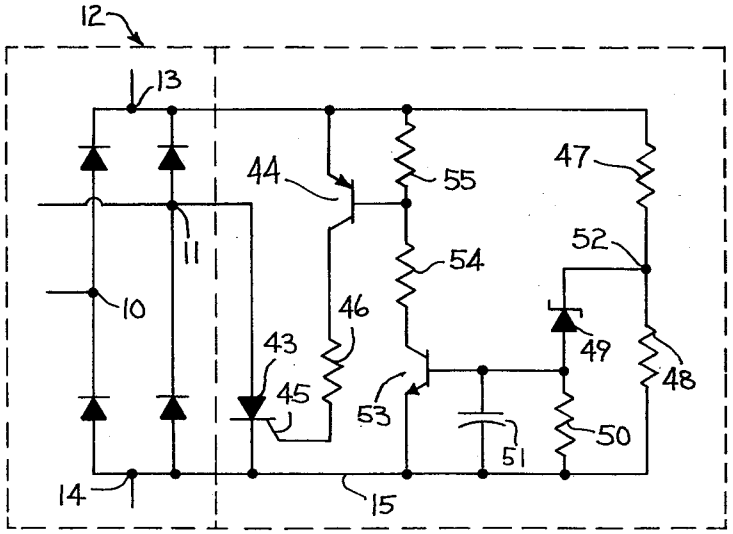
FIG. 2 is a partial schematic illustration of a voltage limited rectifier bridge.

A satisfactory limiting circuit 42 applied to the main or power diode bridge 12 is shown in FIG. 2. The limiting circuit 42 is generally similar to that shown in the copending application of Arthur O. Fitzner, entitled "ELECTRICAL SUPPLY SYSTEM FOR AN INTERNAL COMBUSTION ENGINE", and filed on Jan. 21, 1977 with Ser. No. 760,970, now abandoned and is, therefore, only briefly described herein. The circuit 42 includes a crowbar thyristor 43 connected from input terminal 11 to the return or ground terminal 14. The thyristor 43 is gated on if the alternator input voltage rises above a selected safe level, as follows:

An over-voltage monitor circuit includes a gate current source transistor 44, connected essentially in series between the positive bridge output terminal 13 and the gate 45 of the crowbar thyristor 43. A current limiting resistor 46 is connected in series with the gate 45.

Voltage dividing resistors 47 and 48 are connected across the bridge output terminals 13 and 14 to monitor the voltage level. A Zener diode 49 in series with a resistor 50 and a parallel capacitor 51 connects the common node 52 of resistors 47 and 48 to ground lead 15. The resistor 50 is connected, in turn, across the base and emitter terminals of a control transistor 53 which has its emitter connected directly to the ground lead 15 and its collector connected in series with a pair of resistors 54 and 55 to the positive terminal 13. The base and emitter terminals of the gate current source transistor 44 is connected across resistor 55 to provide turn on bias current to transistor 44 when control transistor 53 turns on. If the voltage across terminals 13 and 14 rises above a selected threshold level, the voltage appearing across resistor 48 is sufficient to cause the Zener diode breakdown voltage to be exceeded and supply base current to the control transistor 53 which is selected to turn on with the current being limited by the series collector resistor 54. Base drive is then provided to transistor 44 by transistor 53. Transistor 44 turns on and supplies gate current to the thyristor 43. Whenever terminal 11 is positive relative to ground, the rectifier 43 is forwarded biased by the output of the alternator unit 7 and shorts the corresponding half-cycle output of the alternator to ground. This limits the average output voltage and protects the fuel pump motor 3 as well as any other auxiliary equipment from abnormally high voltages associated with accidental or involuntary disconnection of the battery 5.

The present invention thus provides a reliable automatic fuel pump control which permits the race driver to directly start the engine without the necessity of attending to the proper timed operation of the fuel supply.

Various modes of carrying out the invention are contemplated as being within the scope of the following claims, particularly pointing out and distinctly claiming the subject matter which is regarded as the invention.

We claim:

1. In an internal combustion engine having a fuel pump means including an electrical pump operator to drive said fuel pump means connected to a power supply system including a battery means and an alternator means having an outward coil means connected to charge said battery means through an appropriate rectifier means, said battery means connected to a reference potential means and said output coil means being connected thereto through said rectifier means, a switch means connected to control the operative connection of the electrical operator to the power supply system, said switch means having an electrically operated input means, sensing means connected to the input means and to the output of the alternator means and responsive to the rotationally generated output to actuate said switch means to complete the operative connection of said operator to said power supply system.

2. In the engine of claim 1 wherein said alternator means includes a permanent magnet alternator having said output coil means and first and second A.C. conductor means connecting said output coil means to said rectifying means, said rectifying means being a full wave power rectifier bridge having first and second input terminal means connected to said first and second A.C. conductor means and having first and second output terminal means, first and second D.C. conductor means connected to said output terminal means and to said battery means to charge the battery means, the more negative one of said output terminal means being connected to a common ground means, the interconnection of said alternator output coil and said full wave bridge and said battery and said common ground means causing non-symmetrical A.C. voltages relative to ground to appear on each of said A.C. conductor means, said sensing means including a full wave rectifier bridge having first and second inputs connected to said first and second A.C. conductor means and having first and second A.C. voltage outputs, a sensing transistor means having a first input means connected to the first output of said sensing bridge and a second input means, first and second unilateral conducting means connecting the second input means to the corresponding first and second A.C. voltage outputs, and said switch being an electronic switch means connected to the output of said transistor means.

3. In the engine of claim 2 including a capacitor means connected in series with the output of the transistor means to the sensing bridge, said capacitor means being charged from the positive output of said sensing bridge through said transistor means, said electronic switch means having an input connected to said sensing transistor means and said capacitor means and having an output connected in series with said pump operator.

4. In the engine of claim 3 wherein said electronic switch means includes a first Darlington transistor unit having an output connected in series with said pump operator, a second Darlington transistor unit having an output connected in series between the battery means and the input of the first Darlington transistor unit and having an input connected to the sensing transistor means and capacitor means.

5. In the engine of claim 4 including a voltage divider connected across the input to said first Darlington transistor unit and having an intermediate node connected to the common input node of the Darlington transistors, and a voltage sensitive unit connected across the input to the second Darlington transistor unit.

6. In the engine of claim 2 having a voltage sensing means connected to the output of power rectifier bridge, and a voltage limiting means connected to the alternator output coil means and limiting the output of the alternator.

7. In an internal combustion engine having a fuel pump means including an operating motor connected to a power supply system including a battery having a positive terminal and a negative terminal and a permanent magnet alternator having an output coil connected to a power rectifier unit, said power rectifier unit being connected to charge said battery, a control transistor switch connected in series with the motor to the positive terminal of the battery, a sensing rectifier having first and second inputs connected to the opposite ends of the output coil, a sensing transistor means having one input element connected to the D.C. output of the sensing rectifier and a second input element connected in series with steering diodes to the two opposite ends of the alternator output coil and responsive to the rotationally generated output voltage to turn said sensing transistor on, and said control transistor switch connected to the output of the sensing means.

8. In the engine of claim 7 including a manually operable primer switch connected in parallel with the control transistor switch.

9. In the engine of claim 7 having a common ground connection for the power supply system and wherein said power rectifier unit has a positive D.C. output terminal connected to said battery means and to said control transistor switch in series with said operating motor to supply power thereto and a negative D.C. output terminal connected to a common ground, and a voltage sensing means connected to the rectifier unit and having a voltage limiting means connected to one of said opposite ends of said output coil and operable at a selected abnormal voltage to limit the output of the alternator.

10. In the engine of claim 7 having a resistor connecting the first input element of said sensing transistor to said D.C. output of the sensing rectifier, a capacitor in parallel with a resistor connected between the sensing transistor means and common ground, a resistor connecting the common ground to the negative side of the sensing rectifier, said capacitor being charged from said D.C. output of the sensing rectifier through said sensing transistor to a selected level, and said control transistor switch being connected to the capacitor means.

11. In the engine of claim 10 wherein said control transistor switch includes a Darlington transistor circuit connected to said sensing transistor means and said capacitor and having an output connected in series with said operating motor.

12. In the engine of claim 10 wherein said control transistor switch includes a first Darlington transistor unit including two transistors connected in a Darlington circuit with a common node and having an output connected in series with said operating motor, a voltage divider connected across the input to said Darlington transistor unit and having an intermediate node connected to the common node of the two transistors, a second Darlington transistor unit having an output connected in series with a current-limiting resistor between the battery supply and the input to the first Darlington transistor unit, a resistor connecting a signal input terminal of the second Darlington transistor unit to the capacitor, and a voltage limiting unit connected to limit the maximum voltage on the capacitor.

* * * * *